US010086917B2

(12) United States Patent
Roodenburg et al.

(10) Patent No.: US 10,086,917 B2
(45) Date of Patent: Oct. 2, 2018

(54) DRILLING VESSEL AND METHOD FOR OPERATING A DRILLING VESSEL ADAPTED TO RUN LARGE DIAMETER CASING STRINGS

(71) Applicant: ITREC B.V., Schiedam (NL)

(72) Inventors: Joop Roodenburg, Schiedam (NL); Diederick Bernardus Wijning, Schiedam (NL)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 15/520,889

(22) PCT Filed: Oct. 23, 2015

(86) PCT No.: PCT/NL2015/050735

§ 371 (c)(1),
(2) Date: Apr. 21, 2017

(87) PCT Pub. No.: WO2016/064275

PCT Pub. Date: Apr. 28, 2016

(65) Prior Publication Data

US 2017/0334528 A1 Nov. 23, 2017

(30) Foreign Application Priority Data

Oct. 24, 2014 (NL) ..... 2013684

(51) Int. Cl.
*E21B 19/00* (2006.01)
*E21B 19/14* (2006.01)
(Continued)

(52) U.S. Cl.
CPC ..... *B63B 35/4413* (2013.01); *B63B 27/04* (2013.01); *E21B 19/004* (2013.01); *E21B 19/143* (2013.01)

(58) Field of Classification Search
CPC .... E21B 19/004; E21B 19/143; E21B 19/155; B63B 27/04; B63B 35/4413
See application file for complete search history.

(56) References Cited

U.S. PATENT DOCUMENTS 3,655,071 A * 4/1972 Langowski ..... E21B 19/15 414/22.58
3,887,086 A * 6/1975 Woolslayer ..... E21B 19/15 414/22.54
(Continued)

FOREIGN PATENT DOCUMENTS

WO WO 2009/102196 A2 8/2009
WO WO 2011/037459 A1 3/2011
(Continued)

*Primary Examiner* — Matthew R Buck
(74) *Attorney, Agent, or Firm* — Birch, Stewart, Kolasch & Birch, LLP

(57) ABSTRACT

The present invention relates to a method for operating a drilling vessel adapted to run large diameters surface casing joints having a diameter of over 20 inch (51 cm) and a length of 30-50 feet (9-15 meters), and build a surface casing string. According to the invention three or more surface casing joints are interconnected into pre-assembled surface casing stands having a length of over 100 feet (30 meters). These surface casing stands are substantially horizontally stored and transferred by a casing stand handling system to a surface casing string handling capacity hoisting device, which subsequently lowers the surface casing string.

10 Claims, 3 Drawing Sheets

(51) Int. Cl.
*B63B 35/44* (2006.01)
*B63B 27/04* (2006.01)

(56) References Cited

U.S. PATENT DOCUMENTS 4,129,221 A * 12/1978 Moller ..... E21B 19/15 175/85
6,609,573 B1 * 8/2003 Day ..... E21B 19/15 166/380
6,705,414 B2 * 3/2004 Simpson ..... E21B 15/003 175/52
6,926,488 B1 * 8/2005 Bolding ..... E21B 19/15 211/70.4
8,291,845 B2 * 10/2012 Wijning ..... B63B 35/4413 114/72
8,678,094 B2 * 3/2014 Banks ..... E21B 19/002 166/352
2012/0103623 A1 * 5/2012 Wijning ..... E21B 19/146 166/352

FOREIGN PATENT DOCUMENTS

WO WO-2012168428 A1 * 12/2012 ..... B63B 35/4413
WO WO 2014/168471 A1 10/2014

* cited by examiner

DRILLING VESSEL AND METHOD FOR OPERATING A DRILLING VESSEL ADAPTED TO RUN LARGE DIAMETER CASING STRINGS

The invention relates to a drilling vessel and a method for operating a drilling vessel adapted to run large diameter casing strings.

In the drilling of boreholes in the earth such as for the production of oil and gas, it is normal practice to run a string of casing into the borehole so as to line the borehole. This primarily is to prevent caving of the borehole walls, and to prevent fluid in formations other than the productive formation from entering a string of casing, and to form a vertical passage through which to produce the desired fluid.

Normally wellbores for well and gas wells have a larger diameter casing portion at the upper end that will be cased by a first string of casing. One or more strings of casing are subsequently installed with each string of casing being smaller in diameter.

The first string of casing in a subsea well may be as large as 60 inch (152 cm) in diameter, generally between 20 inch and 60 inch (51-152 cm), in particular between 36-42 inch (91-107 cm), which may be referred to as a drive pipe or structural pile or conductor pipe or conductor casing. Typically, the first casing string is installed into the seabed to a depth of about 100-500 feet (30-152 meters).

Subsequently, surface casing is installed, having a diameter between 20-22 inch (51-56 cm). Surface casing can run several thousand feet in length. Hereafter, in some wells, protection or intermediate casing having a diameter between 7-14 inch (18-36 cm) is run to separate challenging areas or problem zones, including areas of high pressure or lost circulation.

The last type of casing string that is run into the well, and therefore the smallest in diameter, is the production casing having a diameter between 4-10 inch (10-25 cm), also referred to as an oil string. The oil string is run directly into the producing reservoir.

Casing is fabricated in sections, or joints, that are usually about 40 feet (12 meter) long. Casing joints are connected, e.g. screwed or welded together, to form longer lengths of casing, called casing strings.

Commonly, casing joints are transported by a drilling vessel to a location above the borehole. For example WO2009/102196 discloses mono-hull vessel having a hull and a pipe storage hold within the hull. It is explained that references to pipes should be understood as tubular goods normally required in off-shore drilling operations, such as drill pipes, riser pipes and casing pipes.

In WO2009/102196 a gantry crane is provided to raise and lower the pipe sections out of and into the storage hold and to place each individual pipe section onto a riser catwalk machine or to pick up a pipe section from the catwalk machine. The leading end of the pipe section is in practice connected to a lifting tool which connects the pipe section to a hoisting device of the vessel. By raising the lifting tool and operation of the catwalk machine the pipe section is brought into a vertical orientation, or upended, in line with a firing line along which the pipe is suspended into the sea. The already launched portion of the pipe string is then temporarily held by a pipe string hanger of the vessel. The new pipe section is then held in alignment above the launched pipe string and the pipes are interconnected to join the new pipe section to the pipe string. Then the pipe string is released by the pipe string hanger and lowered over the length of the newly attached section. The pipe string is then suspended again from the pipe string hanger and the process of joining a new pipe section is repeated.

Similar processes in which casing joints are lowered and connected to each other one-by-one are common practice.

It has been found that this known process to assemble a casing string is time-consuming. This is in particular a problem in areas having strong underwater currents, acting upon the suspended casing string while other casing joints are being joined to the casing string.

The present invention aims to propose a vessel and method that allows for improvements over the known approach, in view of pace with which a surface casing string can be assembled, as well as in view of the actual storing and/or handling of surface casing joints on board a vessel.

The invention proposes a drilling vessel and a method for operating such drilling vessel, adapted to run large diameter surface casing strings having a diameter of over 20 inch (51 cm).

It is noted that although the claims refer to the specific term 'surface casing', a skilled person will understand that the vessel and method of the invention are adapted to run any large diameter casing having a diameter of over 20 inch, also if such large diameter casing is otherwise referred to, e.g. as drive pipe or structural pile or conductor pipe or conductor casing.

A drilling vessel according to the invention comprises:

- a hull, e.g. a mono-hull type hull, having a moonpool and a main deck,
- a tower arranged at said moonpool,
- a surface casing storage adapted to store therein multiple surface casing joints having a diameter of over 20 inch (51 cm) and a length of 30-50 feet (9-15 meters),
- a casing pre-assembly installation, adapted to interconnect three or more surface casing joints into surface casing stands having a length of over 100 feet (30 meters),
- a surface casing stand storage on the main deck for storing multiple surface casing stands in a substantially horizontal position,
- a casing string handling capacity hoisting device having a casing string lifting tool connectable to a surface casing stand, which casing handling capacity hoisting device is adapted to lower relative to said tower the surface casing string that is suspended from said casing handling capacity hoisting device in a firing line,
- a casing stand handling system comprising a crane and a catwalk machine that is embodied to transfer surface casing stands between the surface casing stand storage and the casing handling capacity hoisting device,
- a surface casing string hanger adapted to temporarily hold the surface casing string.

According to the invention a surface casing stand storage is provided on the main deck for storing multiple pre-assembled casing stands in a substantially horizontal position. E.g. at least 10 pre-assembled casing stands, each pre-assembled casing stand being assembled from multiple interconnected casing sections. For example, and as preferred, each casing stand consists of three or four surface casing sections.

The invention is based on the insight that the storage of pre-assembled surface casing stands in horizontal orientation allows to make up the connection between the surface casing joints that form a surface casing stand at an early stage. This approach greatly reduces, e.g. by a factor two, the amount of work to be done in the firing line when actually assembling a casing string, and thus significantly reduces time for deployment of a casing string.

The reduced time for deployment of a casing string for example reduces the risk of damage to the casing string during deployment in turbulent waters.

The horizontal storage of surface casing stands is advantageous compared to any vertical storage of pre-assembled casing stands in view of the stability of the stored casing stand, in particular in view of the large diameter and consequent large weight of the surface casing, and in view of vessel stability, in particular when the invention is implemented in a mono-hull vessel. Moreover, in view of the large diameter of the surface casing stands, vertical storage is difficult in conventional set-back or fingerboard facilities.

In embodiments, the tower is a mast and the firing line is provided parallel to and outside of a first side of the mast. Advantageously, a second hoisting device is supported by the mast and a load attachment device is displaceable along a second firing line, which extends on the outside of and adjacent to the second side of the mast, opposite the first side, wherein preferably drilling operations are performed along the second firing line. Such so-called 'multiple firing hoist systems' have been extensively described in previous patent applications of the same applicant and have also been realized in the 'Globetrotter' drilling vessels.

In embodiments, the casing stand handling system is adapted to transfer the pre-assembled surface casing stands between the casing pre-assembly installation and the surface casing stand storage. Such transfer can be achieved e.g. by one or more cranes, such as a knuckleboom crane.

In embodiments, the casing pre-assembly installation is adapted to interconnect three or more vertically oriented surface casing joints into surface casing stands. In alternative embodiments, the casing pre-assembly installation is adapted to interconnect three or more horizontally oriented surface casing joints into surface casing stands.

In embodiments, the catwalk machine includes:

a pair of horizontal catwalk machine rails (85);

an elongated catwalk machine frame having a rear end, a front end, wherein the frame is movable over the catwalk machine rails at least in a rearward loading position and a forward casing release position, wherein—in the rearward loading position—a surface casing stand in horizontal orientation can be loaded onto the catwalk machine, and wherein—in the forward casing release position—the surface casing stand to be lifted is connectable to the surface casing string lifting tool (25), a skate which is supported by the frame and is movable by a drive motor along the length of the frame between a rearward skate position and a forward skate position.

The present invention also relates to a method for operating a drilling vessel adapted to run large diameters surface casing joints and build a surface casing string, comprising the steps of:

a) providing a drilling vessel comprising:

a hull having a moonpool and a main deck, a tower arranged at said moonpool, a surface casing storage adapted to store therein multiple surface casing joints having a diameter of over 20 inch (51 cm) and a length of 30-50 feet (9-15 meters), a casing pre-assembly installation, adapted to interconnect three or more surface casing joints into surface casing stands having a length of over 100 feet (30 meters), a surface casing stand storage on the main deck for storing multiple surface casing stands in a substantially horizontal position, a casing string handling capacity hoisting device having a casing string lifting tool connectable to a surface casing stand, which casing handling capacity hoisting device is adapted to lower relative to said tower the surface casing string that is suspended from said casing handling capacity hoisting device in a firing line, a casing stand handling system comprising a crane and a catwalk machine that is embodied to transfer surface casing stands between the surface casing stand storage and the casing handling capacity hoisting device, b) a surface casing string hanger adapted to temporarily hold the surface casing string interconnecting three or more surface casing joints into surface casing stands having a length of over 100 feet (30 meters);

c) storing the surface casing stands in a substantially horizontal position;

d) operating the casing stand handling system to transfer surface casing stands between the surface casing stand storage and the casing handling capacity hoisting device;

e) connecting the casing lifting tool to a surface casing stand;

f) operating the casing handling capacity hoisting device to lower relative to said tower the surface casing stand that is suspended from said casing handling capacity hoisting device in the firing line;

g) holding the launched portion of the surface casing string in the firing line by the casing string hanger;

h) repeating steps d)-f);

i) aligning the new surface casing stand above the launched surface casing string;

j) interconnecting the surface casing stand and the launched surface casing string;

k) releasing the surface casing string from the casing string hanger;

l) lowering the surface casing string over the length of the newly attached surface casing stand;

m) repeating steps g)-l).

The surface casing stand upending process essentially corresponds to the riser stand upending process described and shown in WO2014/168471 of the same applicant.

The invention also relates to one or more of the following clauses:

1. Drilling vessel (1) adapted to run large diameter surface casing strings, comprising:

a hull (2), e.g. a mono-hull type hull, having a moonpool (5) and a main deck (8, 9), a tower (10) arranged at said moonpool, a surface casing storage (60) adapted to store therein multiple surface casing joints (61) having a diameter of over 20 inch (51 cm) and a length of 30-50 feet (9-15 meters), a casing pre-assembly installation (135), adapted to interconnect three or more surface casing joints into surface casing stands (62) having a length of over 100 feet (30 meters), a surface casing stand storage (65) on the main deck for storing multiple surface casing stands (62) in a substantially horizontal position, a casing string handling capacity hoisting device having a casing string lifting tool (25) connectable to a surface casing stand, which casing handling capacity hoisting device is adapted to lower relative to said tower the surface casing string that is suspended from said casing handling capacity hoisting device in a firing line (20), a casing stand handling system comprising a crane and a catwalk machine (45) that is embodied to transfer surface casing stands between the surface casing stand storage and the casing handling capacity hoisting device, a surface casing string hanger (17) adapted to temporarily hold the surface casing string.

2. Drilling vessel according to clause 1, wherein the tower is a mast (10) and wherein the firing line (20) is provided parallel to and outside of a first side of the mast (10*a*).

3. Drilling vessel according to clause 2, comprising a second hoisting device supported by the mast and having a load attachment device (30) displaceable along a second firing line (21), which extends on the outside of and adjacent to the second side (10*b*) of the mast, opposite the first side (10*a*), wherein preferably drilling operations are performed along the second firing line.

4. Drilling vessel according to any of the preceding clauses, wherein the casing stand handling system is adapted to transfer the pre-assembled surface casing stands between the casing pre-assembly installation and the surface casing stand storage.

5. Drilling vessel according to any of the preceding clauses, wherein the casing pre-assembly installation is adapted to interconnect three or more vertically oriented surface casing joints into surface casing stands.

6. Drilling vessel according to any of the preceding clauses, wherein the casing pre-assembly installation is adapted to interconnect three or more horizontally oriented surface casing joints into surface casing stands.

7. Drilling vessel according to any of the preceding clauses, wherein the catwalk machine includes:

a pair of horizontal catwalk machine rails (85);

an elongated catwalk machine frame having a rear end, a front end, wherein the frame is movable over the catwalk machine rails at least in a rearward loading position and a forward riser release position, wherein—in the rearward loading position—a surface casing stand in horizontal orientation can be loaded onto the catwalk machine, and wherein—in the forward riser release position—the surface casing stand to be lifted is connectable to the surface casing string lifting tool (25), a skate which is supported by the frame and is movable by a drive motor along the length of the frame between a rearward skate position and a forward skate position.

8. Method for operating a drilling vessel adapted to run large diameters surface casing joints and build a surface casing string, comprising the steps of:

a) providing a drilling vessel of clause 1;

b) interconnecting three or more surface casing joints into surface casing stands having a length of over 100 feet (30 meters);

c) storing the surface casing stands in a substantially horizontal position;

d) operating the casing stand handling system to transfer surface casing stands between the surface casing stand storage and the casing handling capacity hoisting device;

e) connecting the casing lifting tool to a surface casing stand;

f) operating the casing handling capacity hoisting device to lower relative to said tower the surface casing stand that is suspended from said casing handling capacity hoisting device in the firing line;

g) holding the launched portion of the surface casing string in the firing line by the casing string hanger;

h) repeating steps d)-f);

i) aligning the new surface casing stand above the launched surface casing string;

j) interconnecting the surface casing stand and the launched surface casing string;

k) releasing the surface casing string from the casing string hanger;

l) lowering the surface casing string over the length of the newly attached surface casing stand;

m) repeating steps g)-l).

The invention will now be described in more detail with reference to the drawings. In the drawings.

Figure 1:
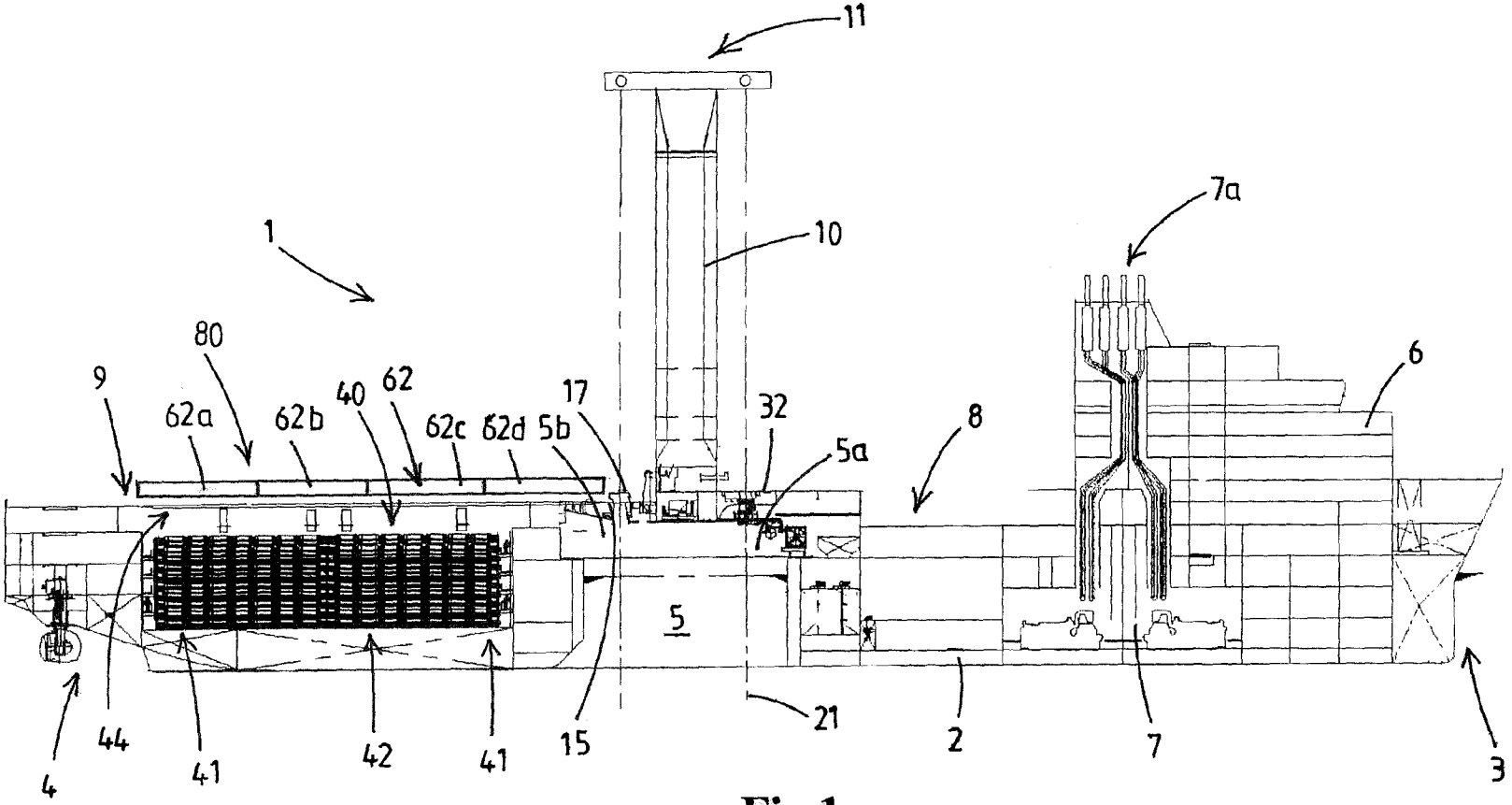
FIG. 1 shows in longitudinal view a vessel according to the invention.

FIG. 1 shows a mono-hull vessel 1 having a hull 2 with a bow 3, a stern 4, and a moonpool 5 that extends through the hull 2.

The vessel 1 is adapted to perform subsea wellbore related operations involving running large diameter surface casing strings from the vessel. Advantageously, the vessel can also perform other subsea wellbore related operations, e.g. drilling operations, in particular involving a riser string, and wellbore intervention.

In this example, the vessel 1 has an accommodation topside 6 at the bow 3, including crew quarters and a bridge.

The vessel 1 has an engine room 7, generally below the accommodation topside, with exhausts 7*a* extending at the rear of the topside 6, above the topside 6.

The moonpool 5 has, as is preferred, a rectangular shape with opposed lateral sides, a front side and a rear side.

A front main deck 8 extends between the moonpool 5 and the topsides.

A rear main deck 9 extends between the moonpool 5 and the stern of the vessel 4.

The vessel is equipped with a tower 10, which is, as is preferred, embodied as a hollow construction mast having a top 11 and having a base 12 that is integral with the hull 2. The base 12 extends between sections of the hull on opposed lateral sides of the moonpool 5 and the base 12 is spaced from each of the front side and the rear side of the moonpool, thereby forming a front moonpool area 5*a* forward of the mast 10 and a rear moonpool area 5*b* rearward of the mast 10.

The mast 10 has a front side 10*a* and an opposed rear side 10*b* as well as opposed lateral sides 10*c*, 10*d*.

In this example, drill pipe racks, here embodied as carrousel type racks 14, are located adjacent the lateral sides of the mast 10, as is known in the art.

At the rear moonpool area 5*b*, the vessel is provided with a working deck 15 arranged above the rear moonpool area 5*b*. As is preferred the working deck 15 is a mobile working deck, here liftable along the mast 10 to such a height that a blow-out preventer can be brought and held underneath the working deck 15 in raised position thereof at an elevated position relative to the mast 10. In a lowered, operative position, the working deck 15 preferably, as here, is level with the adjacent main deck area 9.

In view of assembly of a surface casing string along a firing line 20 through the rear moonpool area 5*b* the vessel is equipped with a casing string hanger 17 that is adapted to temporarily hold and suspend therefrom a surface casing string in the firing line 20 into the sea during the surface casing assembly process. As preferred, this hanger 17 is mounted on the working deck 15. Possibly, the hanger 17 is provided with a gimballing support so as to allow for angular variation between the casing string and the working deck, e.g. due to sea motion of the vessel.

Figure 3:
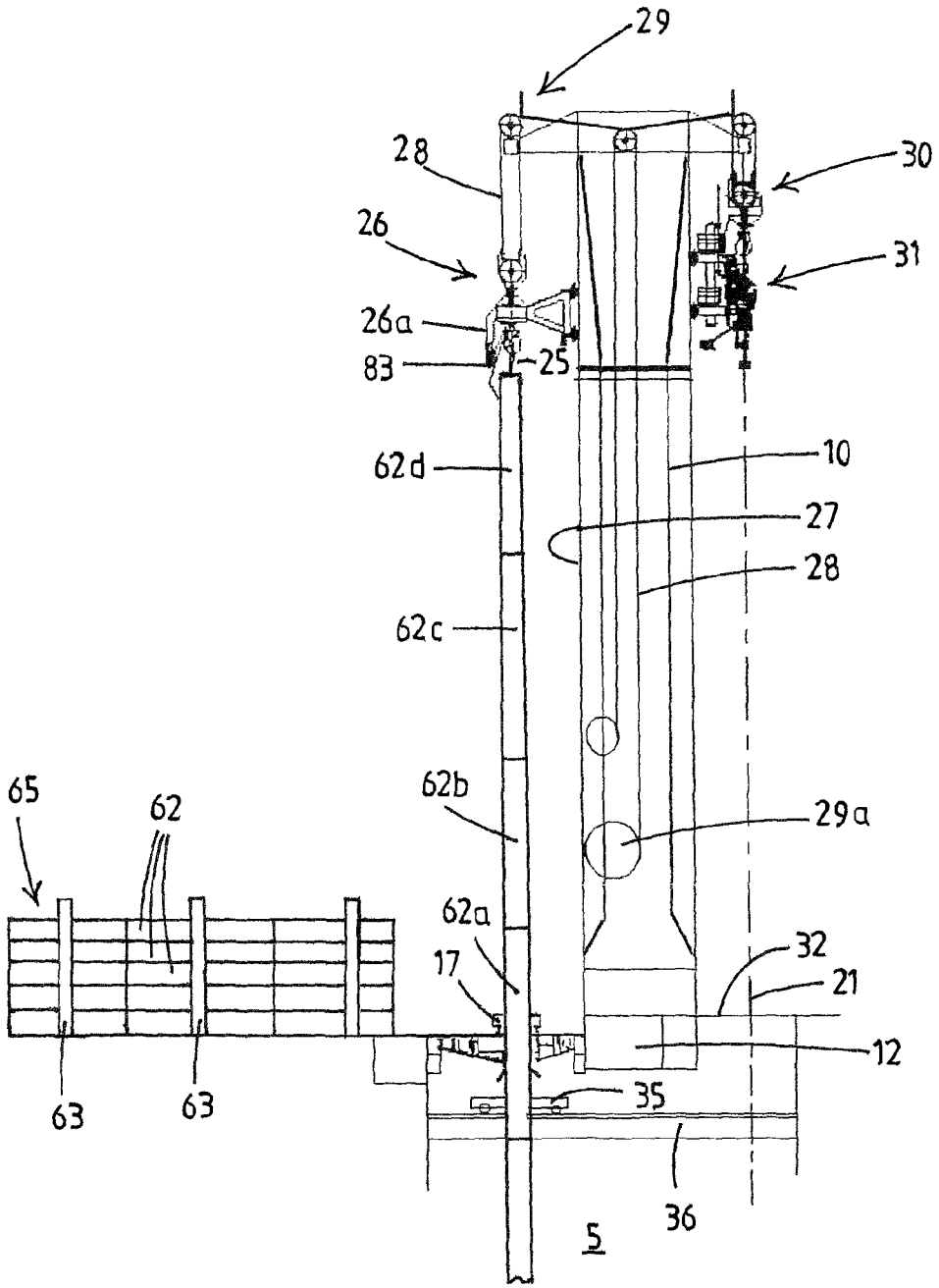
FIG. 3 shows schematically a step in a surface casing stand upending process of the vessel of FIG. 1.

The vessel 1 has a surface casing string handling capacity hoisting device including a casing string lifting tool 25, visible in FIG. 3, which is movable up and down relative to the tower 10 and that is adapted to connect to a surface casing stand 62 and is embodied to support the weight of a surface casing string in the firing line 20 when released from the surface casing string assembly hanger 17.

The surface casing string lifting tool 25 here is suspended from a travelling hanger device 26 that is movable up and down along the rear side of the mast 10 along one or more vertical rails 27.

The hanger device 26 is suspended by one or more cables 28 from a sheave arrangement 29 at the top of the mast, which one or more cables 28 are connected to one or more winches 29*a*, e.g. arranged within the mast 10 (see FIG. 3).

It is noted that in the shown embodiment the firing line 20 is outside of the rear side 10*b* of the mast 10 so that the firing line 20 can be reached without hindrance in the process of upending a surface casing stand from the rear of the vessel.

The vessel further comprises a casing stand handling system that is embodied to transfer surface casing stands between the surface casing stand storage and the casing handling capacity hoisting device. Advantageously, the casing stand handling system comprises a catwalk machine known per se, which is schematically indicated with reference number 45. The casing stand handling system furthermore comprises a crane, which is not visible.

Such a catwalk machine 45 is commonly known, and comprises:

- a pair of horizontal catwalk machine rails 85;
- an elongated catwalk machine frame having a rear end, a front end, wherein the frame is movable over the catwalk machine rails at least in a rearward loading position and a forward casing release position, wherein—in the rearward loading position—a surface casing stand in horizontal orientation can be loaded onto the catwalk machine, and wherein—in the forward casing release position—the surface casing stand to be lifted is connectable to the surface casing string lifting tool 25,
- a skate which is supported by the frame and is movable by a drive motor along the length of the frame between a rearward skate position and a forward skate position.

The drilling vessel further comprises a surface casing storage 60, adapted to store therein multiple surface casing joints 61 having a diameter of over 20 inch (51 cm) and a length of 30-50 feet (9-15 meters). In the shown embodiment, the surface casing storage 60 is provided in the hull of the vessel, adjacent a riser storage hold 40.

Advantageously, both the surface casing storage 60 and the riser storage hold 40 are provided below the main deck area 9. This allows the provision of a surface casing stand storage 65 on the main deck, as visible in FIG. 3, for storing multiple surface casing stands in a substantially horizontal position, and preferably parallel to a longitudinal axis of the vessel 1. As visible in FIG. 3, the surface casing stand storage 65 is adapted to store therein multiple pre-assembled surface casing stands 62, e.g. at least 25 surface casing stands 62. As is shown here, and as preferred, each surface casing stand 62 consists of four interconnected surface casing joints.

The surface casing storage 60 comprises one or more surface casing storage racks adapted to store therein multiple surface casing joints 61 in horizontal orientation. Similarly, the surface casing stand storage 65 also comprises one or more surface casing storage racks 63 adapted to store therein multiple surface casing stands 62 in horizontal orientation, e.g. each storage rack 63 being embodied to support a surface casing stand 62 at end portions thereof as well as at an intermediate portion thereof at or near each connection between surface casing joints of the surface casing stand 62.

In this example the surface casing stands 62 are assembled from four surface casing joints of 45 feet (14 meters), thus having a stand length of 180 feet (55 meters).

The vessel of the invention is furthermore provided with a casing pre-assembly installation 135, adapted to interconnect three or more surface casing joints 61 into surface casing stands 62 having a length of over 100 feet (30 meters). In the shown embodiment, the casing pre-assembly installation 135 is schematically indicated. It is conceivable that the casing pre-assembly installation is provided on the main deck of the drilling vessel, but alternative locations are also conceivable. Pre-assembly, also referred to as stand building, of surface casing joints may take place horizontally on deck. Alternatively, vertical stand building with a vertically orientated pre-assembly installation is conceivable as well.

In embodiments, the casing stand handling system is also adapted to transfer the pre-assembled surface casing stands between the casing pre-assembly installation and the surface casing stand storage. This can be performed by a crane.

In embodiments, the surface casing joints are interconnected in the surface casing stand storage. For example, the surface casing stand storage is provided with welding equipment to interconnect casing joints into casing stands.

Advantageously, as shown in detail in FIG. 3, the vessel also has a second hoisting device having a load attachment device 30 which is movable up and down relative to the mast at a side 10*b* opposed from the riser firing line 20, so as to allow for handling of items passing through the other moonpool area along a second firing line 21 distinct and spaced from the first firing line 20 where the surface casing string assembly takes place.

The second firing line 21 extends through the front moonpool area 5*a*. Along this firing line 21 primarily drilling operations are performed.

The second hoisting device is embodied as a drilling drawworks, and is provided with a topdrive 31 suspended from the load attachment device 30 to perform drilling operations. The load attachment device 30 is preferably embodied similar as the travelling hanger device 26.

A working deck 32 is arranged above the moonpool area 5*a* and may include a rotary table, iron roughneck machine, etc.

Figure 2:
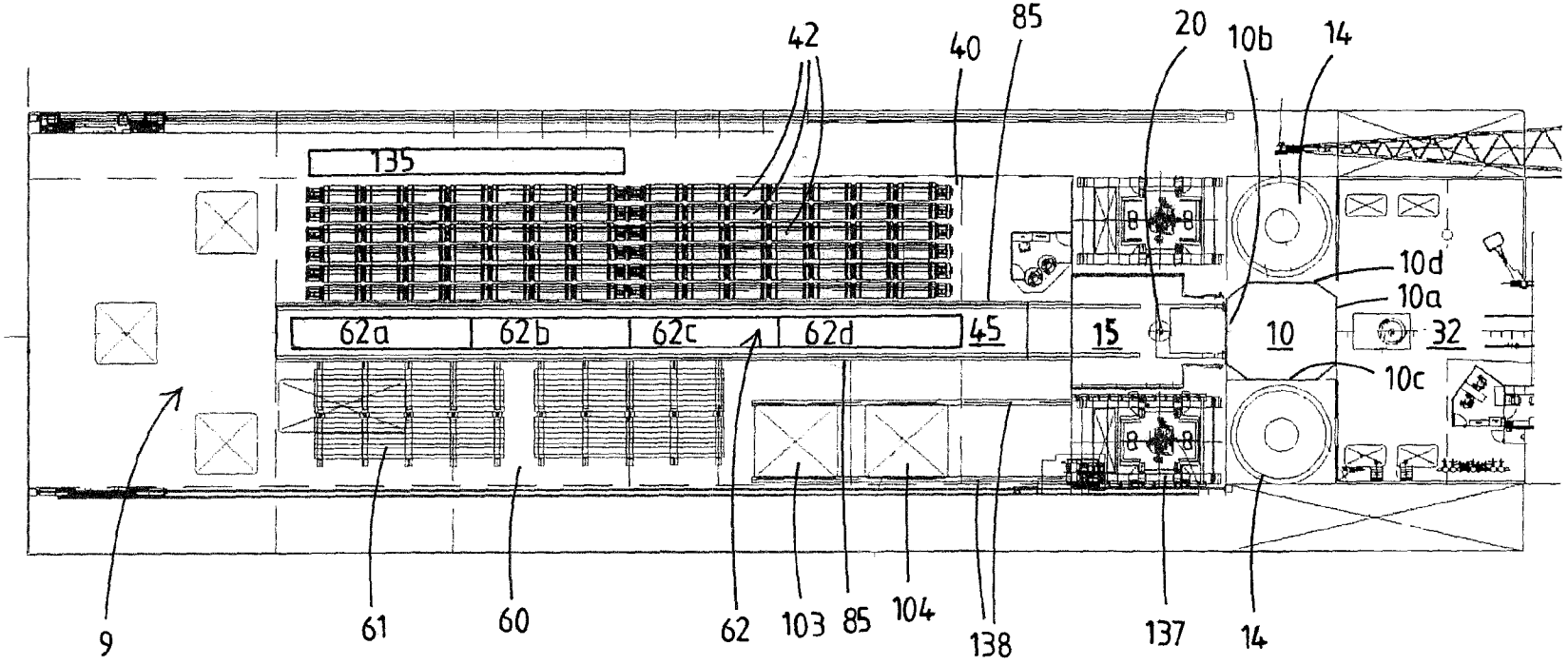
FIG. 2 shows a plan view of the aft part of the vessel of FIG. 1.

Furthermore, in FIG. 2 are visible hatches 103, 104 forming the roof of a blow out preventer BOP storage, and a BOP support cart 137 which is displaceable on rails 138 extending between the one or more roof openings (with hatches 103, 104) of the BOP hold on the one hand and a docking station, generally in longitudinal direction of the vessel.

The vessel 1 is thus capable of assembly of a surface casing string in firing line 20.

Advantageously, the vessel 1 is also capable of assembly of a riser string in firing line 20. For transfer of the riser string to the other firing line 21 a riser string support cart 35 is provided that is displaceable within the moonpool, e.g. skiddable over rails 36 along the lateral sides of the moonpool 5 (see FIG. 3).

The vessel has a riser storage hold 40, here as is preferred, within the hull 2 aft of the moonpool 5. The riser storage hold 40 is embodied to store the riser stands therein in horizontal position and parallel to a longitudinal axis of the vessel 1. In FIG. 2 the riser stands are visible to illustrate the location of the hold 40. As will be explained the hold 40 is covered in this design by a roof that is formed by the rear main deck 9 so that in practice the riser stands in the hold 40 are not visible from above.

The riser storage hold 40 is adapted to store therein, or has stored therein, multiple pre-assembled riser stands 42, e.g. at least 25 riser stands 42. As is shown here, and as preferred, each riser stand 42 consists of two riser sections.

The riser storage hold 40 comprises one or more riser storage racks 41 adapted to store therein multiple riser stands 42 in horizontal orientation, e.g. each storage rack being embodied to support a riser stand at end portions thereof as well as at an intermediate portion thereof at or near each connection between riser sections of the riser stand.

In this example the riser stands 42 each have a length of 150 ft. (45.72 m).

The riser storage hold 40 has a roof 44 formed by the structure of the main deck 9.

The invention claimed is:

1. A method for running surface casing from a drilling vessel adapted to handle large diameter surface casing joints each having a diameter of over 20 inch (51 cm) and a length of 30-50 feet (9-15 meters), and build a surface casing string from said joints, comprising the step of using the drilling vessel which is provided with:

a deck with a surface casing stand storage;

a casing stand handling system comprising a crane and a catwalk machine;

a surface casing string handling capacity hoisting device having a surface casing string lifting tool connectable to a surface casing stand; and a surface casing string hanger, wherein the method comprises the steps of:

a) interconnecting, on said vessel, three or more surface casing joints each having a diameter of over 20 inch (51 cm) and a length of 30-50 feet (9-15 meters) into pre-assembled surface casing stands each having a length of over 100 feet (30 meters);

b) storing the pre-assembled surface casing stands in the surface casing stand storage in a substantially horizontal position;

c) operating the casing stand handling system to transfer a first pre-assembled surface casing stand of the pre-assembled surface casing stands from the surface casing stand storage to the surface casing string handling capacity hoisting device;

d) connecting the casing lifting tool to said first surface casing stand;

e) lifting said first surface casing stand such that the first surface casing stand is suspended in a substantially vertical position from said surface casing string handling capacity hoisting device in a firing line;

f) operating the surface casing string handling capacity hoisting device to lower the first surface casing stand in said firing line;

g) temporarily holding the lowered first surface casing stand in the firing line by the surface casing string hanger and disconnecting the first surface casing stand from the casing lifting tool;

h) repeating steps d)-f) for a second pre-assembled surface casing stand of the pre-assembled surface casing stands;

i) aligning the second surface casing stand above the first surface casing stand;

j) interconnecting the second surface casing stand and the first surface casing stand to form a surface casing string;

k) releasing the surface casing string from the casing string hanger;

l) lowering the surface casing string over the length of the second surface casing stand by the casing lifting tool;

m) temporarily holding the surface casing string in the firing line by the surface casing string hanger and disconnecting the surface casing string from the casing lifting tool;

n) repeating steps d)-f) and i)-l) for a third pre-assembled surface casing stand of the pre-assembled surface casing stands.

2. The method according to claim 1, wherein the drilling vessel is provided with a casing pre-assembly installation in which step b) is performed.

3. The method according to claim 1, wherein the drilling vessel is provided with a surface casing storage adapted to store therein multiple surface casing joints, distinct from the surface casing stand storage.

4. The method according to claim 2, wherein the casing stand handling system is adapted to transfer the pre-assembled surface casing stands between the casing pre-assembly installation and the surface casing stand storage.

5. The method according to claim 1, wherein in step b) three or more vertically oriented surface casing joints are interconnected into surface casing stands.

6. The method according to claim 1, wherein in step b) three or more horizontally oriented surface casing joints are interconnected into surface casing stands.

7. The method according to claim 1, wherein the drilling vessel comprises a hull having a moonpool and a main deck and a tower arranged at said moonpool, wherein the surface casing string is lowered relative to said tower through the moonpool.

8. The method according to claim 7, wherein the tower is a mast and wherein the firing line is provided parallel to and outside of a first side of the mast.

9. The method according to claim 1, wherein the vessel is provided with a second hoisting device having a load attachment device, and wherein the method further comprises the steps of performing drilling operations along a second firing line distinct from the first firing line.

10. The method according to claim 1, wherein the catwalk machine includes:

a pair of horizontal catwalk machine rails;

an elongated catwalk machine frame having a rear end and a front end; and a skate supported by the frame and movable by a drive motor along the length of the frame between a rearward skate position and a forward skate position, and wherein the method comprises the steps of:

positioning the frame over the catwalk machine rails in a rearward loading position;

loading a surface casing stand in horizontal orientation onto the catwalk machine in the rearward loading position of the frame;

moving the frame over the catwalk machine rails to a forward casing release position; and connecting the surface casing stand to be lifted to the surface casing string lifting tool in the forward casing release position.

* * * * *